United States Patent [19]

Aponte

[11] Patent Number: 4,572,514

[45] Date of Patent: Feb. 25, 1986

[54] MILITARY BOARD GAME

[76] Inventor: Guillermo Aponte, Presidente Gonzalez #14 Ens. Naco, Santo Domingo, Venezuela

[21] Appl. No.: 478,299

[22] Filed: Mar. 24, 1983

[51] Int. Cl.[4] ..... A63F 3/00

[52] U.S. Cl. ..... 273/255

[58] Field of Search ..... 273/248, 249, 258, 250, 273/251, 252, 253, 288, DIG. 27, 255, 262

[56] References Cited

U.S. PATENT DOCUMENTS

| | | | |
|---|---|---|---|
| 690,656 | 1/1902 | Lasker . | |
| 1,713,455 | 5/1929 | Stickney | 273/262 |
| 1,798,701 | 3/1931 | Reed . | |
| 1,867,053 | 7/1932 | Blanck . | |
| 2,052,797 | 9/1936 | Read | 273/288 |
| 2,277,301 | 3/1942 | Channer . | |
| 2,557,583 | 6/1951 | Vitale | 273/248 |
| 2,964,323 | 12/1960 | Moses | 273/255 |
| 3,414,264 | 12/1968 | Schriber | 273/249 |
| 3,560,127 | 2/1971 | Imperato | 273/249 X |
| 3,642,286 | 2/1972 | Moore | 273/243 |
| 4,082,284 | 4/1978 | Jennings | 273/251 |
| 4,215,866 | 8/1980 | Shimizu | 273/275 |
| 4,261,574 | 4/1981 | Rogers, Jr. | 273/253 |

FOREIGN PATENT DOCUMENTS

| | | | |
|---|---|---|---|
| 560302 | 3/1944 | United Kingdom | 273/288 |

*Primary Examiner*—William H. Grieb
*Assistant Examiner*—Scott L. Brown

[57] ABSTRACT

A military game featuring in one aspect a game board marked with a multiplicity of columns, each column being marked into a multiplicity of spaces and having uniquely associated with it indicia of a type of military force, a multiplicity of playing pieces, each piece being uniquely marked with corresponding indicia of the types of military force, and two dice, each face of one die being uniquely marked with corresponding unique indicia of the types of military force and each face of the other die being marked with a number, the throw of the dice determining which of the playing pieces to move and the number of spaces it is to be moved. The columns also have spaces designating cards. An award chart is provided identifying awards for playing pieces moved all the way along a column and being placed on a separate continent block.

8 Claims, 5 Drawing Figures

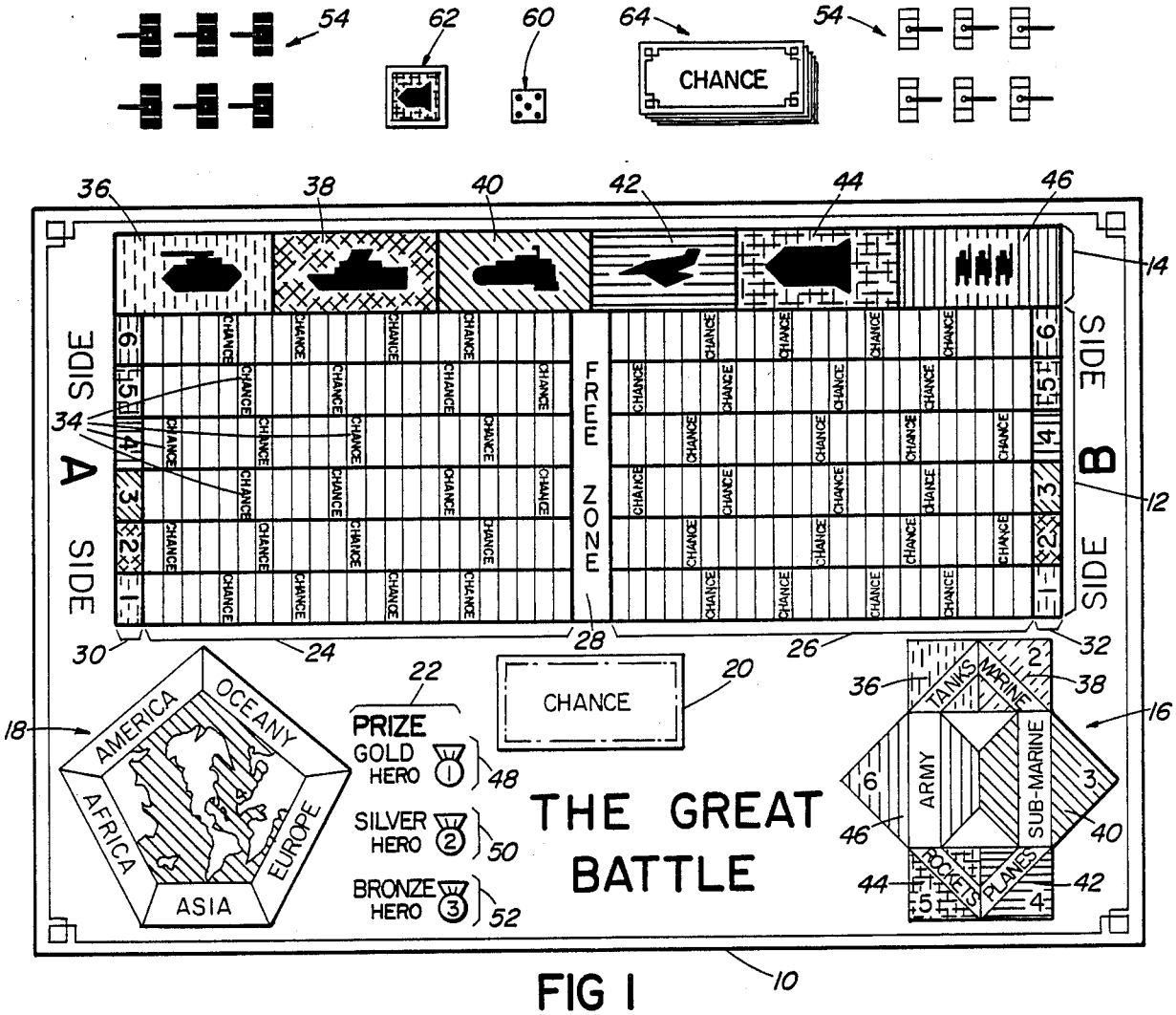
FIG 1
FIG 2
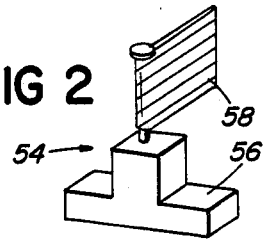
FIG 3
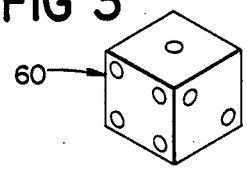
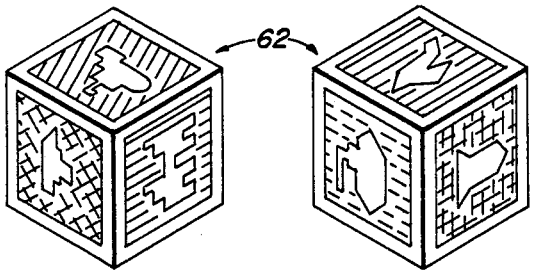
FIG 4
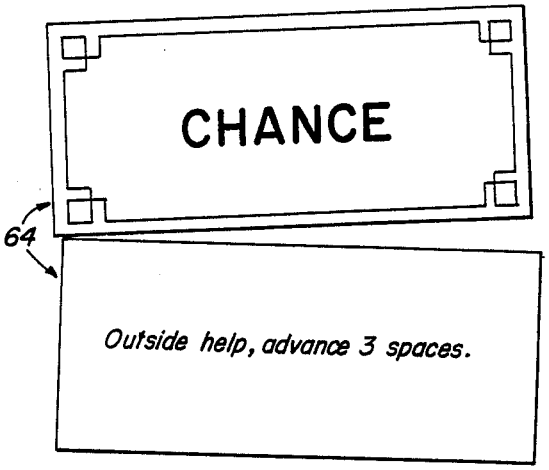
FIG 5

MILITARY BOARD GAME

BACKGROUND OF THE INVENTION

This invention relates to military board games. Examples of military games can be found in Rogers, Jr. U.S. Pat. No. 4,261,574, Reed U.S. Pat. No. 1,798,701, Moses U.S. Pat. No. 2,964,323, Vitale U.S. Pat. No. 2,557,583, Channer U.S. Pat. No. 2,277,301, Blanck U.S. Pat. No. 1,867,053, and Lasker U.S. Pat. No. 690,656.

SUMMARY OF THE INVENTION

In general, the invention features in one aspect a game board marked with a multiplicity of columns, each column being marked into a multiplicity of spaces and having uniquely associated with it indicia of a type of military force, a multiplicity of playing pieces, each piece being uniquely marked with corresponding inidicia of the types of military force, and two dice, each face of one die being uniquely marked with corresponding unique indicia of the types of military force and each face of the other die being marked with a number, the throw of the dice determining which of the playing pieces to move and the number of spaces it is to be moved.

In preferred embodiments, each of the different types of military force is represented by at least three different indicia, the indicia being from the group comprising a color uniquely associated with each type of military force, a pictoral representation uniquely associated with each type of military force, a number uniquely associated with each type of military force, and a word designation uniquely associated with each type of military force. In this preferred embodiment the game board further comprises a first indicia key juxtaposing at least two of the indicia, and a second indicia key juxtaposing at least two of the indicia, the indicia juxtaposed on the second key not being the same indicia juxtaposed on the first key, and each playing piece comprises a base, the base being of one color for half of the playing pieces and of another color for the other half of the playing pieces, and a flag, the flag being marked with at least one indicium of one of the different types of military force.

In another aspect the invention features a military game comprising a game board marked with a multiplicity of columns of spaces, some of the spaces in each column being designated as a "chance" space, a multiplicity of playing pieces, two dice, one die being a piece-denoting die and the other die being a conventional numbered die, the throw of the dice determining the initial movement of the playing pieces, and instruction cards, one card being drawn each time the initial movement of one of the playing pieces as determined by the roll of the two dice ends on a "chance" space, each movement of a playing piece having a first phase controlled by the throw of the two dice and a possible second phase controlled by the instructions on the instruction cards.

In preferred embodiments the "chance" spaces are designated by imprinting the word "chance" on the game board within the spaces desired to be so designated.

In another aspect the invention features a military game comprising a game board having a movement portion marked into two opposing territories, each territory being separated from the other by a free zone, each territory being marked into a multiplicity of columns and each column being marked with a multiplicity of spaces, the columns and spaces being the primary area of play, a continent block, the block being marked with indicia of different continents, wherein movement of a playing piece to the block reflects the success of the piece in moving through the opposing territory, and an award-identification chart, the chart identifying the different prizes awarded for successfully moving different numbers of playing pieces to the continent block, a multiplicity of playing pieces, and means for controlling the movement of the playing pieces comprising a piece-denoting die, a numbered die, and instruction cards.

In preferred embodiments the continent block identifies five continents, the indicia of the continents are the names of the continents, America, Oceany, Europe, Asia, and Africa, and the award-identification chart identifies three prizes, the Gold Medal Hero, the Silver Medal Hero, and the Bronze Medal Hero.

The invention thus provides a game which is entertaining and easy to learn. Since movement of the pieces is controlled by elements of chance, beginners are not at a disadvantage vis-a-vis more experienced players, and persons of all ages and skill levels can enjoy playing the game together.

Other features and advantages of the invention will be apparent from the following description of the preferred embodiment thereof, and from the claims.

DESCRIPTION OF THE PREFERRED EMBODIMENT

We first briefly describe the drawings.

DRAWINGS

FIG. 1 is a plan view of the game board and pieces.

FIG. 2 is a perspective view of a playing piece.

FIG. 3 is a perspective view of the numbered die.

FIG. 4 is a perspective view of the piece-denoting die shown twice in different positions to show all six faces.

FIG. 5 is a plan view of the front and back of an instruction card.

BOARD AND PIECES

Referring to FIG. 1, game board 10 has a portion marked into a grid 12, a first indicia key 14, a second indicia key 16, a continent block 18, a chance block 20, and an award-identification chart 22. Grid 12 has two halves 24, 26 denoted Side A and Side B, respectively, separated by free zone 28. Each half 24, 26 is marked into six columns of 23 spaces each and is bounded at the exterior edge by a base strip 30, 32, respectively. Four "chance" spaces 34 are randomly marked in each column of each half 24,26. Base strips 30, 32 are divided into six spaces corresponding to the six columns. Each of these six spaces is colored and numbered to correspond to one of the six types of military force 36, 38, 40, 42, 44, 46 depicted on first indicia key 14 and second indicia key 16. In the most preferred embodiment, tanks 36 are identified by the outline of a tank, the color purple, and the number 1; marine forces 38 are identified by the outline of a ship, the color orange and the number 2; sub-marines 40 are identified by the outline of a submarine, the color green and the number 3; planes 42 are identified by the outline of a plane, the color blue and the number 4; rockets 44 are identified by the outline of a rocket, the color yellow and the number 5; and the army 46 is identified by the outline of soldiers, the color red and the number 6. The columns of each half 24,26 are arranged such that each type of military force of Side A is opposite its counterpart of Side B. For example, when Side A's plane crosses the free zone, it will be in the same column as Side B's plane. The color and outline of each of the different types of military force are juxtaposed on first indicia key 14, and the color, name, and number of each of the different types of military force are juxtaposed on second indicia key 16. Continent block 18 identifies five continents, America, Oceany, Europe, Asia, and Africa. Award-identification chart 22 identifies the Gold Medal Hero prize 48, the Silver Medal Hero prize 50, and the Bronze Medal Hero prize 52. These prizes are awarded to the players in the order of their success in reaching the opposing base strip, with the Gold Medal Hero prize indicating the greatest success, the Silver Medal Hero prize indicating the second-greatest success, and the Bronze Medal Hero prize indicating the third greatest success.

Referring to FIG. 2, playing piece 54 has a base 56 and a flag 58. Base 56 is of one color, for example black, for the playing pieces of Side A and of another color, for example white, for the playing pieces of Side B. Flags 58 are marked with one or more indicia of a type of military force. In the most preferred embodiment flags 58 are color-coded to correspond to one of the six types of military force. For example, a purple flag on a black base would denote the playing piece as Side A's tanks, while a red flag on a white base would denote Side B's army. The playing pieces are initially positioned in the space of base strips 30, 32 to which the base 56 and the flag 58 correspond. For example, the playing piece with a blue flag on a black base would be placed in the space numbered 4 (colored blue) of Side A's base strip.

Two dice are used to control the movement of the playing pieces. The first die (FIG. 3) is a conventional numbered die 60, with the faces numbered from one to six. The second die is the piece-denoting die 62 (FIG. 4). Each face of piece-denoting die 62 corresponds to one of the six types of military force. For example, one face bears the outline of a rocket surrounded by the color yellow, another face bears the outline of a ship surrounded by the color orange, and so on.

Instruction cards 64 (FIG. 5) have one face which bears the word "Chance" and an opposing face bearing instructions. For example, the instructions might read "Bridge out-lose one turn" or "Outside help, advance three spaces". These cards are placed on chance block 20 of game board 10 before play is commenced.

PLAY OF THE GAME

The game may be played by an even number of players from two to twelve.

TWO PLAYERS

The players first choose the side and base color they desire, and place the playing pieces on the appropriate space of the base strip. The numbered die is then thrown once by each player, with the player rolling the highest number taking the first turn. Both dice are then rolled, the piece-denoting die indicating which piece is to be moved and the numbered die indicating how many spaces that piece is to be moved. If a playing piece lands on a chance space, an instruction card is drawn, the instructions are followed, and the card is returned to the stack of instruction cards. Certain instruction cards are marked with one of two types of bombs. The first is an atomic bomb which "destroys" one continent by forcing one of the opponent's playing pieces which has already conquered a continent back to its base. The second is a neutron bomb which similarly "destroys" two continents. If a bomb card cannot be immediately used (i.e., the opponent has not yet conquered a continent), the card may be saved for use at a later time. Once the card is used it is placed back in the stack of chance cards.

The playing pieces are moved forward toward the opposing player's base strip. If a piece lands on a space already occupied by the opposing player's piece, the advance of that piece is stopped by the opposing player's piece and it must return to its own base strip. If the pieces meet on the free zone or on a chance space, however, both pieces may remain on the space. The playing pieces are restricted to moving only in the column to which they are initially assigned, lateral or diagonal movement being prohibited. The pieces move only in a forward direction unless forced back by the action of an opposing piece or chance card. Playing pieces are not "destroyed" or "captured" by opposing pieces but are only forced back to their respective starting positions. In order to invade the opposing player's base strip, the exact number of spaces must be rolled on the numbered die, with the base strip counting as one space.

Once the opposing player's base strip has been reached, the playing piece may be moved to one of the continents on the continent block, thereby conquering that continent. The first player to conquer three continents wins the game and the Gold Medal Hero prize.

FOUR PLAYERS

The players first choose which side each wishes to start on and which units of military force each wishes to control, such that Side A and Side B are each divided into two parts of three units each. The numbered die is thrown once by each player, with the player throwing the highest number taking the first turn. The order of play then proceeds in a clockwise direction. To play, both dice are rolled, but if one of the units controlled by the player rolling the dice is not thrown, no piece is moved and the next player continues play.

Play proceeds as described for two players. Any player conquering three continents receives the Gold Medal Hero prize, any player conquering two continents receives the Silver Medal Hero prize, and any player conquering one continent receives the Bronze Medal Hero prize.

SIX PLAYERS

Each player controls two military units, and play proceeds as described for four players. Instead of only being able to destroy continents, however, the atomic and neutron bombs can be used to force back an opponent's most advanced military unit or an opponent's two most advance military units, respectively. The cards may be used immediately after being drawn or when the player considers it most convenient. Any player conquering two continents receives the Gold Medal Hero prize and any player conquering one continent receives the Silver Medal Hero prize. After the Gold Medal Hero prize and the Silver Medal Hero prize are awarded, the remaining players continue play. The Bronze Medal Hero prize is awarded to the first player of those remaining to reach the opposite front.

EIGHT, TEN, OR TWELVE PLAYERS

Each player controls one military unit. In the case of less than twelve players, the players must choose the sides and types of military force to be controlled such that for each piece being played from Side A's base strip, its counterpart is being played from Side B's base strip. That is, no piece can move in a column in which an opposing piece is not being moved. The remaining units are not involved in the play of the game. The piece-denoting die is not used; only the numbered die is thrown to determine the initial move of the piece. Play otherwise proceeds as described for six players.

The first player to reach the opposing front receives the Gold Medal Hero prize, the second player to reach the opposing front receives the Silver Medal Hero prize, and the third player to reach the opposing front receives the Bronze Medal hero prize.

TOURNAMENT PLAY

For purposes of tournament play each type of prize is assigned a given number of points. For example, the Gold Medal Hero prize is 15 points, the Silver Medal Hero prize is 10 points, and the Bronze Medal Hero prize is 5 points. Any convenient tallying system may then be used. For example, an average score may be determined by summing the products of the number of each type of medal won times its respective assigned point value and dividing that sum by the number of games played.

Other embodiments are within the following claims. For example, the indicia of the different types of military force could include a single letter or initials instead of the numbers or pictures, and the designation of the chance spaces could be the letter "C" instead of the word chance.

I claim:

1. A military board game comprising a game board, said board having a movement portion marked with a multiplicity of columns, each said column being marked into a multiplicity of spaces and each column having uniquely associated with it indicia of a type of military force, said movement portion being marked into two opposing territories separated from each other by a free space, some of said spaces in each said columns being designated as "chance" spaces, a multiplicity of playing pieces, each said piece being uniquely marked with corresponding indicia of one said type of miltary force, each said piece being restricted to movement along the corresponding marked column two dice which, when thrown, together determine the initial movement of said pieces, each face of one said die being uniquely marked with corresponding unique indicia of one said type of military force and each face of the other said die being marked with a number, the throw of said dice determining which of said playing pieces to move, which column it is to be moved in, and the initial number of said spaces it is to be moved in said column, instruction cards, one said card being drawn each time the initial movement of one of said playing pieces as determined by the roll of said dice ends on one of said "chance" spaces, each movement of said playing pieces having a first phase controlled by the throw of said dice and a possible second phase controlled by the instructions on said instruction cards, a single continent block separate from said movement portion, said block being marked with indicia of different continents to which playing pieces proceeding in either direction along the column of said board are moved to indicate success of said piece in moving through the opposing territory, and an award-identification chart, said chart identifying different prizes awarded for successfully moving different numbers of playing pieces to said continent block.

2. The game of claim 1 wherein each of said different types of military force is represented on said board by at least three different indicia, said indicia being from the group comprising a color uniquely associated with each said type of military force, a pictoral representation uniquely associated with each said type of military force, a number uniquely associated with each said type of military force, and a word designation uniquely associated with each said type of military force.

3. The game of claim 1 wherein the game board further comprises a first indicia key, said first key juxtaposing at least two of said indicia, and a second indicia key, said second key juxtaposing at least two of said indicia, said indicia juxtaposed on said second key not being the same said indicia juxtaposed on said first key.

4. The game of claim 1 wherein each said playing piece comprises a base, said base being of one color for half of said playing pieces and of another color for the other half of said playing pieces, and a flag, said flag being marked with at least one said indicium of one of said different types of military force.

5. The game of claim 1 wherein said "chance" spaces are so designated by imprinting the word "chance" on said game board within said space.

6. The game of claim 1 wherein said continent block identifies five continents.

7. The game of claim 1 wherein said indicia of said different continents comprises the names of said continents, America, Oceany, Europe, Asia, and Africa.

8. The game of claim 1 wherein said award-identification chart identifies three prizes, the Gold Medal Hero, the Silver Medal Hero, and the Bronze Medal Hero.

* * * * *